US006086191A

United States Patent [19]

Yano et al.

[11] Patent Number: 6,086,191

[45] **Date of Patent: *Jul. 11, 2000**

[54] METHOD FOR CLEANING AN INK HOLDING MATERIAL

[75] Inventors: Toshiyuki Yano; Etsuo Sagara; Toshitake Yui; Akihiko Chujo; Ken Hashimoto; Yasuharu Endo, all of Minami Ashigara, Japan

[73] Assignee: Fuji Xerox Co., LTD, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/647,786

[22] Filed: May 15, 1996

[30] Foreign Application Priority Data

May 18, 1995 [JP] Japan ..... 7-142362

[51] Int. Cl.[7] ..... B41J 2/175

[52] U.S. Cl. ..... 347/85

[58] Field of Search ..... 347/85, 86, 87; 73/64.48

[56] References Cited

U.S. PATENT DOCUMENTS

| | | | |
|---|---|---|---|
| 4,226,911 | 10/1980 | Haren | 428/375 |
| 4,824,487 | 4/1989 | Heffernan | 134/10 |
| 4,885,932 | 12/1989 | Heffernan et al. | 73/64.48 |

FOREIGN PATENT DOCUMENTS

| | | | |
|---|---|---|---|
| 0 466 093 A2 | 1/1992 | European Pat. Off. . | |
| 562733 | 9/1993 | European Pat. Off. | 347/87 |
| 63-87242 | 4/1988 | Japan . | |
| 2-514 | 1/1990 | Japan . | |
| 2-34353 | 2/1990 | Japan . | |
| 3-87266 | 4/1991 | Japan . | |
| 3-136854 | 6/1991 | Japan . | |
| 3-136861 | 6/1991 | Japan . | |
| 6-255121 | 9/1994 | Japan . | |
| 7-323566 | 12/1995 | Japan . | |
| 2 052 251 | 1/1981 | United Kingdom . | |

*Primary Examiner*—John Barlow
*Attorney, Agent, or Firm*—Oliff & Berridge, PLC

[57] ABSTRACT

Disclosed is an ink holding material to be put in an ink tank of an ink jet recording device, which is such that when it is extracted with pure water, the electrical conductivities and the surface tensions of the water before and after the extraction satisfy relationship (1):

$$350 \geqq \gamma r/\sigma r - \gamma s/\sigma s \geqq 0 \quad (1)$$

wherein γr represents the surface tension (mN/m) of pure water before extraction; σr represents the electrical conductivity (mS/m) of pure water before extraction; γs represents the surface tension (mN/m) of pure water after extraction; and σs represents the electrical conductivity (mS/m) of pure water after extraction.

12 Claims, 1 Drawing Sheet

METHOD FOR CLEANING AN INK HOLDING MATERIAL

FIELD OF THE INVENTION

This invention relates to an ink holding material used in an ink cartridge of a high-definition and low-noise recording device, particularly an ink holding material put in an ink tank of an ink jet recording device which is used in such small-sized printers that users can exchange the ink jet cartridges.

BACKGROUND OF THE INVENTION

Conventional integral ink jet cartridges and exchangeable ink jet cartridges of ink jet printers require a complicated valve system in order to prevent ink leaks from the pressure release valve open to the atmosphere in the case of the former cartridges or from the joint of the ink tank and the ink jet head in the case of the latter cartridges. Hence, it has been proposed to provide an ink holding member in an ink tank so as to avoid the above-mentioned problems of conventional ink tanks.

Ink holding members which have hitherto been proposed for use in the inside of an ink tank include the foamed material disclosed in JP-A-63-87242 (the term "JP-A" as used herein means an "unexamined published Japanese patent application"), the member capable of retaining liquid disclosed in JP-A-2-514, the porous member disclosed in JP-A- 2-34353 and JP-A-3-87266, the ink absorbing member disclosed in JP-A-3-136854, and the porous or fibrous material disclosed in JP-A-3-136861. A kind of polyurethane sponge is known as a material of these ink holding members.

In the production of the conventional ink holding member, foamed materials, such as polyurethane foam, easily provide a porous structure having uniform porosity and have excellent ink holding ability for some kinds of inks. However, the foamed material is unsatisfactory as a means for efficiently furnishing ink to nozzles through which the ink is spouted. That is, the foamed material should be provided with a density gradient by, for example, mechanical compression so as to have such a shape that ink is easily transferred. Further, in cases where an ink holding member made of such a porous material has low wettability, ink filling at the time of shipping from factories is a time-consuming operation.

In order to solve the above-described problems, it has been proposed to use general fibrous materials as ink holding material. A fibrous material can be provided with a density gradient so as to give excellent ink transfer properties by an easy operation of changing the fiber density when it is put in an ink tank. In addition, since a fibrous material can have a high porocity, it is easy to fill the fibrous ink holding member with ink even if the material has poor wettability.

However, a fibrous material must be cut to an appropriate size before it is put in an ink tank. It follows that the fiber dust generated on cutting runs with ink and reaches the recording head, resulting in deterioration of ink jet properties. Means which have been taken against this problem include a filter, etc. which is provided between an ink tank and a recording head to inhibit the fiber dust from reaching the recording head. In addition to the above problem, natural fibers are associated with the disadvantage that various impurities inherent to natural fibers, such as fats and oils, run with ink or react with each other, resulting in deterioration of ink characteristics or ink jet properties. On the other hand, chemical fibers contain various additives added during the preparation, such as antistatic agents, smoothing agents, and emulsifying agents, affect the ink to cause deterioration of ink characteristics or ink jet properties.

Accordingly, the present invention has been completed in the light of the above-mentioned problems of conventional techniques.

SUMMARY OF THE INVENTION

An object of the present invention is to provide an ink holding material put in an ink tank of an ink jet recording device, which material has proper ink holding ability, makes it possible to efficiently supply the ink in the ink tank to nozzles for ink jet, and does not cause deterioration of ink characteristics or ink jet properties; and to provide a process for producing the material.

Another object of the invention is to provide an ink tank containing the aforesaid ink holding material, an ink jet recording device equipped with the ink tank, and an ink jet recording method.

In order to accomplish the above objects, the inventors of the present invention have conducted extensive study on an ink holding material to be put in an ink tank of an ink jet recording device. As a result, they have found specific nonwoven fabric as a novel ink holding material and thus reached the present invention, the nonwoven fabric having the following properties: when it is extracted with pure water, the water used for extraction has an electrical conductivity and a surface tension both satisfying relationship (1) hereinafter described.

The ink holding material of the invention is to be put in an ink tank of an ink jet recording device and comprises such nonwoven fabric that when it is extracted with pure water, the electrical conductivities and the surface tensions of the water before and after the extraction satisfy relationship (1):

$$350 \geqq \gamma r/\sigma r - \gamma s/\sigma s \geqq 0 \quad (1)$$

wherein $\gamma r$ represents the surface tension (mN/m) of pure water before extraction; $\sigma r$ represents the electrical conductivity (mS/m) of pure water before extraction; $\gamma s$ represents the surface tension (mN/m) of resultant water after extraction; and $\sigma s$ represents the electrical conductivity (mS/m) of resultant water after extraction.

The extracting operation according to the present invention is carried out by immersing 2 g of an ink holding material in 100 g of pure water having an electrical conductivity of not higher than 0.2 mS/m and a surface tension of not higher than 71 mN/m and centrifugally separating the extractant from the ink holding material. The term "electrical conductivity" (hereinafter simply referred to as conductivity) as used herein means a value obtained by measurement with Model AOL 40 manufactured by Denki Kagaku Keiki K.K. at 23° C., and the term "surface tension" as used herein means a value obtained by measurement with Model CPVP-A3 (Wilhelmy's method) manufactured by Kyowa Kaimen Kagaku K.K. at 23° C.

The ink holding material of the invention can be prepared by cleaning untreated nonwoven fabric with liquid comprising water as a main component. It can also be prepared by washing untreated nonwoven fabric at least once with liquid comprising water as a main component followed by further cleaning at least once with pure water.

The ink tank of the ink jet recording device according to the present invention contains therein the above-mentioned ink holding material. The ink jet recording device of the invention comprises an ink jet recording head and an ink tank for furnishing ink to the recording head, which is characterized in that the ink tank contains the above-mentioned ink holding material impregnated with an aqueous ink.

The ink jet recording method according to the present invention comprises furnishing an aqueous ink from an ink tank containing the above-described ink holding material to an ink jet recording head and spouting the aqueous ink from the ink jet recording head.

DETAILED DESCRIPTION OF THE INVENTION

Figure 1:
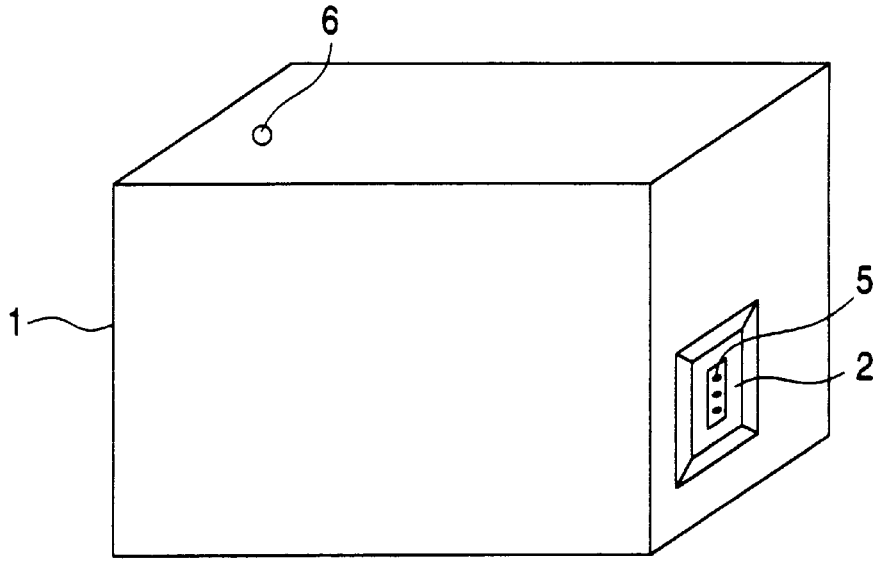
FIG. 1 is a perspective view of an ink jet recording device having an ink tank containing the ink holding material of the invention.

The present invention will be described in detail.

Known fibrous materials can be used for fabricating the nonwoven fabric of the invention. Specific but non-limiting examples of useful fibrous materials include natural fibers, such as wool, cotton, and silk; chemical fibers, such as polyester, polyamide, polyacrylonitrile, polypropylene, and cellulose; and mixed fibrous materials thereof. The fibrous materials may contain filler(s) to control the fiber strength or surface conditions. Examples of the filler include titania, alumina, carbon black and silica. The filler may be used in an amount of 0.1 to 10 wt % based on the ink holding material. From the standpoint of stability of product quality, chemical fibers are preferred. From the standpoint of heat stability, chemical stability and strength, polyester fibers are particularly preferred.

The fibrous material preferably has a fiber length of 5 to 200 mm, still preferably 10 to 120 mm. If the fiber length is too short, the fiber dust generated on cutting increases. If it is too long, variations among individual products after cutting tend to occur. The fibrous material preferably has a fiber diameter of 0.5 to 10 denier, still preferably 0.5 to 8 denier. If the fiber diameter is too small, the fiber strength is weak, making it difficult to provide a density gradient. If it is too large, the fiber density becomes high, resulting in reduction of ink holding capacity (the amount of ink which can be charged) or ink retention. While not limiting, the fibrous material preferably has a circular contour from the standpoint of breaking strength.

It is necessary to properly select the length, diameter, and contour of the fibers in accordance with the characteristics demanded of the ink holding material.

Nonwoven fabric can be prepared from the fibrous materials by known techniques, such as stitch bonding, spun bonding, needle punching, resin bonding, and melt flow. Needle punching is preferred for simplicity of operation.

The nonwoven fabric preferably has a density of 0.04 to 0.3 g/cm$^3$, still preferably 0.06 to 0.15 g/cm$^3$, under the condition that no load is imposed. At too low a density, sufficient ink retention cannot be ensured. At too high a density, the amount of ink which can be charged is reduced.

The ink holding material of the invention can be prepared by cleaning the nonwoven fabric as obtained above with liquid comprising water as a main component. A cleaning temperature preferably ranges from 40 to 80° C. At too low a temperature, the cleaning ability tends to be reduced. At too high a temperature, the workability is reduced. If the fibrous material composing the nonwoven fabric contains trace amounts of water-insoluble components, such as low-molecular weight compounds, the nonwoven fabric may be previously treated with an organic solvent, etc. if desired.

The liquid comprising water as a main component to be used for cleaning may contain other components in addition to water. Examples of other components include ionic surface active agents, nonionic surface active agents, water-soluble organic solvents, and acidic or alkaline materials. Preferred of them are nonionic surface active agents, with ethylene oxide adducts being particularly preferred. The water-soluble organic solvents include alcohols, e.g., ethanol and diethylene glycol monobutyl ether (butyl carbitol); and polyols, e.g., ethylene glycol, diethylene glycol, polyethylene glycol, propylene glycol, and glycerol. The organic solvent may be mixed with water in a proportion of 0.01 to 45% by weight based on water. The (ionic or nonionic) surface active agent may be used in an amount of 0.1 to 5 wt % based on water. The acid or alkaline material may be used in an amount of 0.1 to 5 wt % based on water. Materials to be added to the aqueous ink used can also be added to the cleaning liquid, which is recommended for excluding the interaction between the ink holding material and the aqueous ink on actual use for printing. The cleaning liquid may further contain bactericidal agents, antimicrobial agents, antifungals, sequestering agents, flocculants, and the like.

While not limiting, cleaning of the nonwoven fabric can be carried out by repetition of immersion in the liquid comprising water as a main component with or without agitation and/or ultrasonication, followed by removal of the liquid remaining in the nonwoven fabric by compression, centrifugation, heat drying, vacuum drying, or the like operation.

That is, the ink holding material can be prepared by a process comprising the steps of immersing the untreated nonwoven fabric in the liquid comprising water as a main component with or without agitation and/or with or without ultrasonication (immersion step) and removing the liquid remaining in the nonwoven fabric by centrifugal force (liquid removal step). The immersion step and the liquid removal step are preferably repeated at least once again.

After cleaning the untreated nonwoven fabric with liquid comprising water as a main component at least once, the nonwoven fabric may further be cleaned with pure water once or more times. More specifically, the ink holding material may be prepared by a process comprising the steps of immersing the untreated nonwoven fabric in the liquid comprising water as a main component with or without agitation and/or with or without ultrasonication, removing the liquid remaining in the nonwoven fabric by centrifugal force, immersing the thus treated nonwoven fabric in pure water with or without agitation and/or with or without ultrasonication, and removing the liquid remaining in the nonwoven fabric by centrifugal force.

Further, the process may comprise repeating at least once the steps of immersing the untreated nonwoven fabric in the liquid comprising water as a main component with or without agitation and/or with or without ultrasonication and removing the liquid remaining in the nonwoven fabric by centrifugal force; and repeating at least once the steps of immersing the thus treated nonwoven fabric in pure water with or without agitation and/or with or without ultrasonication and removing the liquid remaining in the nonwoven fabric by centrifugal force.

In the present invention, in addition to the nonwoven fabric, an ink holding material such as urethane foam, sponge or fabric may be also singly used as the ink material of the present invention, if it is processed in the same manner as in the nonwoven fabric described above to satisfy the above relationship (1).

In the resulting ink holding material, it is essentially required that the nonwoven fabric be such that when it is extracted with pure water, the electrical conductivities and the surface tensions of the water before and after the extraction satisfy relationship (1) shown above. Should $\gamma r/\sigma r-\gamma s/\sigma s$ be greater than 350, the ink jet stability is deteriorated to cause such troubles as poor directionality of ink jets from nozzles, failure of spouting ink jets from nozzles, and formation of deposits in the vicinities of the heat source.

Recording heads which can be used in the ink jet recording devices of the invention include those of charge control system which make use of static attraction to spout aqueous ink jets, those of drop-on-demand system (pressure pulse system) which make use of the oscillating pressure of a piezoelectric element to spout aqueous ink jets, and those of thermal ink jet system in which bubbles are generated and grown by high temperature application and the resultant pressure is made use of to spout aqueous ink jets. The recording heads of thermal ink jet system are preferably used for their highly improved durability.

The aqueous ink which can be used in the ink jet recording device of the invention essentially comprises water and a colorant. If desired, the aqueous ink may contain various additives, such as humectants, penetrants, surface active agents, dispersants, clathrate compounds, and the like. In particular, aqueous inks containing humectants or surface active agents are preferably used for their highly improved stability in jetting. Suitable humectants include polyols, such as ethylene glycol, diethylene glycol, polyethylene glycol, propylene glycol, and glycerol. Preferred surface active agents include nonionic surface active agents.

When used in the ink tank of cartridge type ink jet recording devices, the ink holding material of the invention holds an aqueous ink without leaks from the tank and properly furnishes the ink. Further, it can maintain ink jet properties in a stable manner without undergoing interaction with the aqueous ink which would cause deterioration of ink characteristics or ink jet properties.

The ink holding material of the invention is also applicable to ink jet recording devices of the types that do not require aqueous ink retention. For example, it can be used as a small part of the ink tank or the ink furnishing passageway thereby to easily control the amount of ink feed.

EXAMPLES

The present invention will now be illustrated in greater detail with reference to Examples and Comparative Examples, but it should be understood that the invention is not construed as being limited thereto.

Figure 2:
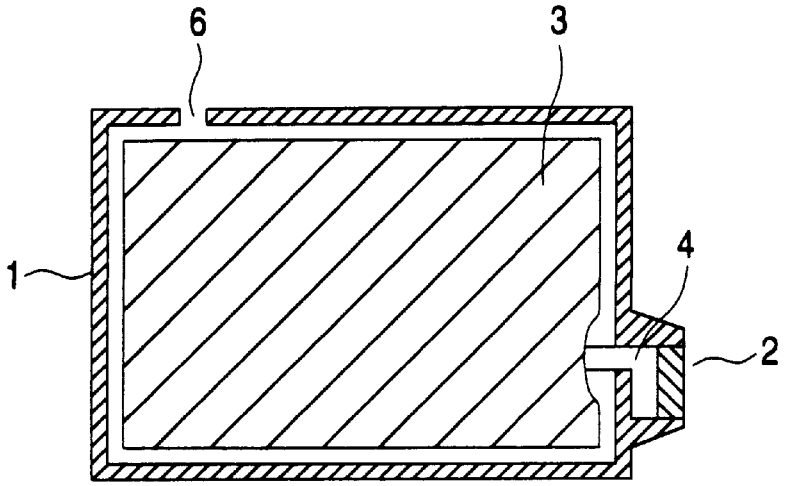
FIG. 2 is a cross sectional view of FIG. 1.

The ink jet recording device shown in FIGS. 1 and 2 comprises ink tank 1 for ink feed and recording head 2 for spouting ink jets. Ink tank 1 comprises a box as an outer wall in which ink holding material 3 is put. An aqueous ink is fed to ink holding material 3 to impregnate the material with the ink. Ink passageway 4 is provided in one side wall of the box, and recording head 2 is fitted to the outside of ink passageway 4. The recording head has an ink spouting surface having a large number of ink spouting nozzles. Numeral 6 is a vent hole open to the air.

The above-described ink jet recording device is used with its ink holding material in ink tank 1 filled with ink. The ink held by the ink holding material passes through ink passageway 4 through a filter, furnished to the ink spouting part of the recording head, and spouted from nozzles 5 in accordance with ink jet signals.

The pure water used in Examples and Comparative Examples had an electrical conductivity ($\sigma r$) of 0.10 mS/m and a surface tension ($\gamma r$) of 72.5 mN/m, both as measured at 23° C.

Example 1

Nonwoven fabric having a basis weight of 900 g/m$^2$ and a thickness (as allowed to stand) of 15 mm was obtained by mechanically binding fibers of an aggregate of polyester fibers (1.5 denier; length: 60 mm) by needle punching. The nonwoven fabric was cut to an appropriate size fit to an ink tank.

The nonwoven fabric was immersed in pure water with agitation. After the nonwoven fabric was taken out of water, the water remaining therein was centrifugally removed. The immersion in water and removal of water were repeated once to obtain an ink holding material.

Example 2

The same cut piece of nonwoven fabric as used in Example 1 was immersed in pure water with agitation and the water remaining therein was centrifugally removed. The immersion in water and removal of water were repeated 4 times to obtain an ink holding material.

Example 3

The same cut piece of nonwoven fabric as used in Example 1 was immersed in a 1 wt % aqueous solution of polyoxyethylene alkylnonyl ether with agitation, and the solution remaining in the nonwoven fabric was removed by centrifugation. The resulting nonwoven fabric was further immersed in pure water with agitation, and the water remaining therein was centrifugally removed. The immersion in pure water and the subsequent water removal were repeated once to obtain an ink holding material.

Example 4

The same cut piece of nonwoven fabric as used in Example 1 was immersed in a 1 wt % aqueous solution of polyoxyethylene alkylnonyl ether with agitation, and the solution remaining in the nonwoven fabric was removed by centrifugation. The resulting nonwoven fabric was further immersed in pure water with agitation, and the water remaining therein was centrifugally removed. The immersion in pure water and the subsequent water removal were repeated 4 times in total to obtain an ink holding material.

Example 5

The same cut piece of nonwoven fabric as used in Example 1 was immersed in a 20 wt % aqueous solution of ethyl alcohol with agitation, and the solution remaining in the nonwoven fabric was removed by centrifugation. The resulting nonwoven fabric was further immersed in pure water with agitation, and the water remaining therein was centrifugally removed. The immersion in pure water and the subsequent water removal were repeated once to obtain an ink holding material.

Example 6

The same cut piece of nonwoven fabric as used in Example 1 was immersed in a 20 wt % aqueous solution of ethyl alcohol with agitation, and the solution remaining in the nonwoven fabric was removed by centrifugation. The resulting nonwoven fabric was further immersed in pure water with agitation, and the water remaining therein was centrifugally removed. The immersion in pure water and the subsequent water removal were repeated 4 times to obtain an ink holding material.

Example 7

Nonwoven fabric having a basis weight of 1,000 g/m$^2$ and a thickness (as allowed to stand) of 17 mm was obtained by mechanically binding fibers of an aggregate of polyamide fibers (2.0 denier; length: 70 mm) by needle punching. The nonwoven fabric was cut to an appropriate size fit to an ink tank.

The resulting nonwoven fabric was treated in the same manner as in Example 4 to obtain an ink holding material.

Example 8

Nonwoven fabric having a basis weight of 900 g/m$^2$ and a thickness (as allowed to stand) of 16 mm was obtained by mechanically binding fibers of an aggregate of acrylonitrile fibers (1.5 denier; length: 70 mm) by needle punching. The nonwoven fabric was cut to an appropriate size fit to an ink tank.

The resulting nonwoven fabric was treated in the same manner as in Example 4 to obtain an ink holding material.

Example 9

Nonwoven fabric having a basis weight of 1,100 g/m$^2$ and a thickness (as allowed to stand) of 15 mm was obtained by mechanically binding fibers of an aggregate of polypropylene fibers (2.0 denier; length: 60 mm) by needle punching. The nonwoven fabric was cut to an appropriate size fit to an ink tank.

The resulting nonwoven fabric was treated in the same manner as in Example 4 to obtain an ink holding material.

Example 10

Nonwoven fabric having a basis weight of 1,100 g/m$^2$ and a thickness (as allowed to stand) of 17 mm was obtained by mechanically binding fibers of an aggregate of cellulose fibers (2.0 denier; length: 70 mm) by needle punching. The nonwoven fabric was cut to an appropriate size fit to an ink tank.

The resulting nonwoven fabric was treated in the same manner as in Example 2 to obtain an ink holding material.

Example 11

Nonwoven fabric having a basis weight of 1000 g/m$^2$ and a thickness (as allowed to stand) of 17 mm was obtained by mechanically binding fibers of an aggregate of polyaramid fibers (1.5 denier; length: 80 mm) by needle punching. The nonwoven fabric was cut to an appropriate size fit to an ink tank.

The resulting nonwoven fabric was treated in the same manner as in Example 2 to obtain an ink holding material.

Example 12

The same cut piece of nonwoven fabric as used in Example 1 was immersed in an aqueous solution having the following composition with agitation, and the solution remaining in the nonwoven fabric was removed by centrifugation. The resulting nonwoven fabric was further immersed in pure water with agitation, and the water remaining therein was centrifugally removed. The immersion in pure water and the subsequent water removal were repeated 4 times to obtain an ink holding material.

| | |
|---|---|
| Diethylene glycol | 20.00 wt % |
| Ethyl alcohol | 4.00 wt % |
| Polyoxyethylene lauryl ether (10 mole adduct) | 0.05 wt % |
| Pure water | 75.95 wt % |

Example 13

The same cut piece of nonwoven fabric as used in Example 1 was immersed in an aqueous solution having the following composition with agitation, and the solution remaining in the nonwoven fabric was removed by centrifugation. The resulting nonwoven fabric was further immersed in pure water with agitation, and the water remaining therein was centrifugally removed. The immersion in pure water and the subsequent water removal were repeated 4 times to obtain an ink holding material.

| | |
|---|---|
| Glycerol | 15.0 wt % |
| Butyl carbitol | 3.0 wt % |
| Direct Black 168 | 2.0 wt % |
| Pure water | 80.0 wt % |

Example 14

The same cut piece of nonwoven fabric as used in Example 1 was immersed in pure water at 70° C. with agitation, and the water remaining in the nonwoven fabric was removed by centrifugation. The immersion water and the subsequent water removal were repeated twice to obtain an ink holding material.

Comparative Example 1

Nonwoven fabric having a basis weight of 900 g/m$^2$ and a thickness (as allowed to stand) of 15 mm was obtained by mechanically binding fibers of an aggregate of polyester fibers (1.5 denier; length: 60 mm) by needle punching. The nonwoven fabric was cut to an appropriate size fit to an ink tank to prepare an ink holding material.

Comparative Example 2

Nonwoven fabric having a basis weight of 1,000 g/m$^2$ and a thickness (as allowed to stand) of 17 mm was obtained by mechanically binding fibers of an aggregate of polyamide fibers (2.0 denier; length: 70 mm) by needle punching. The nonwoven fabric was cut to an appropriate size fit to an ink tank to prepare an ink holding material.

Comparative Example 3

Nonwoven fabric having a basis weight of 900 g/m$^2$ and a thickness (as allowed to stand) of 16 mm was obtained by mechanically binding fibers of an aggregate of acrylonitrile fibers (1.5 denier; length: 70 mm) by needle punching. The nonwoven fabric was cut to an appropriate size fit to an ink tank to prepare an ink holding material.

Comparative Example 4

Nonwoven fabric having a basis weight of 1,100 g/m$^2$ and a thickness (as allowed to stand) of 15 mm was obtained by mechanically binding fibers of an aggregate of polypropylene fibers (2.0 denier; length: 60 mm) by needle punching.

The nonwoven fabric was cut to an appropriate size fit to an ink tank to prepare an ink holding material.

Comparative Example 5

Nonwoven fabric having a basis weight of 1,100 g/m$^2$ and a thickness (as allowed to stand) of 17 mm was obtained by mechanically binding fibers of an aggregate of cellulose fibers (2.0 denier; length: 70 mm) by needle punching. The nonwoven fabric was cut to an appropriate size fit to an ink tank to prepare an ink holding material.

Each of the ink holding materials obtained in Examples 1 to 14 and comparative examples 1 to 5 was extracted with pure water. The results of measurement are shown in Table 1 below.

TABLE 1

| | γs (mN/m) | σs (mS/m) | γs/σs—γs/σs |
|---|---|---|---|
| Example 1 | 72.3 | 0.19 | 344 |
| Example 2 | 72.4 | 0.13 | 168 |
| Example 3 | 69.5 | 0.15 | 262 |
| Example 4 | 72.1 | 0.12 | 124 |
| Example 5 | 71.2 | 0.16 | 280 |
| Example 6 | 72.2 | 0.11 | 69 |
| Example 7 | 72.1 | 0.15 | 244 |
| Example 8 | 72.3 | 0.12 | 123 |
| Example 9 | 72.4 | 0.11 | 67 |
| Example 10 | 72.0 | 0.15 | 245 |
| Example 11 | 72.1 | 0.14 | 210 |
| Example 12 | 71.5 | 0.15 | 248 |
| Example 13 | 71.2 | 0.17 | 306 |
| Example 14 | 72.4 | 0.15 | 242 |
| Comparative Example 1 | 62.1 | 1.07 | 667 |
| Comparative Example 2 | 65.7 | 0.72 | 634 |
| Comparative Example 3 | 62.5 | 0.32 | 530 |
| Comparative Example 4 | 68.1 | 0.25 | 453 |
| Comparative Example 5 | 61.9 | 0.77 | 645 |

Each of the ink holding materials of Examples 1 to 14 and Comparative Examples 1 to 5 was put in an ink tank and tested for (1) ink jet stability, (2) formation of deposit in the vicinities of the heat source, and (3) ink jet stability after storage. The results obtained are shown in Tables 2 and 3 below.

The tests (1) to (3) were carried out using a printer equipped with the ink jet recording head described below and an aqueous ink having the following formulation.

Aqueous Ink:

| | |
|---|---|
| Direct Black 168 | 3.50 wt % |
| Diethylene glycol | 20.00 wt % |
| Ethyl alcohol | 4.00 wt % |
| Polyoxyethylene lauryl ether (10 mole adduct) | 0.05 wt % |
| Pure water | 72.45 wt % |

Ink Jet Recording Head:

Thermal ink jet system (128 nozzles made by chemical treatment of silicone)

Driving frequency: 4 kHz

1) Ink jet stability:

A continuous ink jet test was carried out at 20° C. and 50% RH until the rate of ink use reached 80%. Occurrence of failure of ink spouting through nozzles and occurrence of poor directionality of the ink jets were observed.

2) Deposit in the vicinities of heat source:

After the ink jet stability test (1), the ink jet recording head was taken apart to observe whether any deposit was formed in the vicinities of the heat source under an optical microscope.

3) Ink jet stability after storage:

An ink tank containing the ink holding material impregnated with the ink was put in a closed container and stored at 60° C. for 30 days and then subjected to the test (1).

TABLE 2

| | Ink Jet Stability | Deposit in the vicinities of heat source |
|---|---|---|
| Example 1 | satisfactory till 80% ink use | slight deposit observed |
| Example 2 | satisfactory till 80% ink use | no deposit observed |
| Example 3 | satisfactory till 80% ink use | no deposit observed |
| Example 4 | satisfactory till 80% ink use | no deposit observed |
| Example 5 | satisfactory till 80% ink use | no deposit observed |
| Example 6 | satisfactory till 80% ink use | no deposit observed |
| Example 7 | satisfactory till 80% ink use | no deposit observed |
| Example 8 | satisfactory till 80% ink use | no deposit observed |
| Example 9 | satisfactory till 80% ink use | no deposit observed |
| Example 10 | satisfactory till 80% ink use | no deposit observed |
| Example 11 | satisfactory till 80% ink use | no deposit observed |
| Example 12 | satisfactory till 80% ink use | no deposit observed |
| Example 13 | satisfactory till 80% ink use | no deposit observed |
| Example 14 | satisfactory till 80% ink use | no deposit observed |
| Comparative Example 1 | poor directionality of the ink jets observed at 60% ink use | slight deposit observed |
| Comparative Example 2 | failure of ink spouting through nozzles observed at 40% ink use | deposit observed |
| Comparative Example 3 | failure of ink spouting through nozzles observed at 50% ink use | deposit observed |
| Comparative Example 4 | failure of ink spouting through nozzles observed at 60% ink use | deposit observed |
| Comparative Example 5 | poor directionality of the ink jets observed at 50% ink use | deposit observed |

TABLE 3

| | Ink Jet Stability After Storage |
|---|---|
| Example 1 | satisfactory till 80% ink use |
| Example 2 | satisfactory till 80% ink use |
| Example 3 | satisfactory till 80% ink use |
| Example 4 | satisfactory till 80% ink use |
| Example 5 | satisfactory till 80% ink use |
| Example 6 | satisfactory till 80% ink use |
| Example 7 | satisfactory till 80% ink use |
| Example 8 | satisfactory till 80% ink use |
| Example 9 | satisfactory till 80% ink use |
| Example 10 | satisfactory till 80% ink use |
| Example 11 | satisfactory till 80% ink use |
| Example 12 | satisfactory till 80% ink use |
| Example 13 | satisfactory till 80% ink use |
| Example 14 | satisfactory till 80% ink use |
| Comparative Example 1 | poor directionality of the ink jets observed at 15% ink use, and failure of ink spouting through nozzles observed at 60% ink use |
| Comparative Example 2 | failure of ink spouting through nozzles observed at 20% ink use |
| Comparative Example 3 | failure of ink spouting through nozzles observed at 40% ink use |
| Comparative Example 4 | failure of ink spouting through nozzles observed at 50% ink use |
| Comparative Example 5 | poor directionality of the ink jets observed at 10% ink use, and failure of ink spouting through nozzles observed at 40% ink use |

Having the above-described constitution, the ink holding material of the invention possesses appropriate ink holding ability without causing deterioration of ink characteristics or ink jet properties and thereby makes it possible to efficiently furnish an aqueous ink in an ink tank to nozzles through which ink jets are spouted. Therefore, an ink jet recording device equipped with an ink tank containing the ink holding material can maintain stable ink jet properties and can make effective use of the aqueous ink.

While the invention has been described in detail and with reference to specific examples thereof, it will be apparent to one skilled in the art-that various changes and modifications can be made therein without departing from the spirit and scope thereof.

What is claimed is:

1. A method for cleaning an ink holding material, comprising the steps of:

providing an ink holding material; and cleaning the ink holding material with a liquid comprising pure water as a main component by immersing the ink holding material in the liquid and subsequently extracting the liquid from the ink holding material by centrifugal force so that when the liquid is extracted therefrom electrical conductivities and surface tensions of the liquid before and after extraction satisfy a relationship as follows:

$$350 \geqq \gamma r/\sigma r - \gamma s/\sigma s \geqq 0$$

wherein γr represents the surface tension (mN/m) of the liquid before extraction; σr represents the electrical conductivity (mS/m) of the liquid before extraction; γs represents the surface tension (mN/m) of the liquid after extraction; and σs represents the electrical conductivity (mS/m) of the liquid after extraction.

2. The process for producing an ink holding material according to claim 1, wherein the cleaning step comprises the steps of:

(i) immersing the ink holding material in the liquid comprising pure water as a main component with or without agitation and with or without ultrasonication to prepare a first immersed ink holding material;

(ii) removing the liquid remaining in the first immersed ink holding material by centrifugal force;

(iii) repeating the immersing step (i) and the removing step (ii) at least once to prepare a liquid-treated ink holding material;

(iv) immersing the liquid-treated ink holding material in pure water with or without agitation and/or with or without ultrasonication to prepare a second immersed ink holding material;

(v) removing the liquid remaining in the second immersed ink holding material by centrifugal force to prepare a liquid-removed ink holding material; and (vi) repeating the immersing step (iv) and the removing step (v).

3. The method according to claim 1, wherein the ink holding material comprises nonwoven fabric.

4. The method according to claim 3, wherein the nonwoven fabric comprises chemical fiber as a main component.

5. The method according to claim 1, wherein the cleaning step comprises the steps of:

(i) immersing the ink holding material in the liquid comprising pure water as a main component with or without agitation and with or without ultrasonication to prepare an immersed ink holding material and (ii) removing the liquid remaining in the immersed ink holding material by centrifugal force, (iii) repeating the immersing step (i) and the removing step (ii) at least once.

6. The method according to claim 1, wherein the cleaning step comprises cleaning the ink holding material with the liquid comprising pure water as a main component to prepare a cleaned ink holding material at least once and then cleaning the cleaned ink holding material with pure water at least once.

7. The method according to claim 1, wherein the cleaning step comprises the steps of:

(i) immersing the ink holding material in the liquid comprising pure water as a main component with or without agitation and with or without ultrasonication to prepare a first immersed ink holding material;

(ii) removing the liquid remaining in the first immersed ink holding material by centrifugal force to prepare a liquid-removed ink holding material;

(iii) immersing the liquid-removed ink holding material in pure water with or without agitation and with or without ultrasonication to prepare a second immersed ink holding material; and (iv) removing the liquid remaining in the second immersed ink holding material by centrifugal force.

8. A method for cleaning an ink holding material, comprising the steps of:

immersing an ink absorbent material in a liquid containing substantially water; and extracting the liquid from the ink absorbent material by centrifugal force, wherein a first ratio defined as a first surface tension characteristic of the liquid before the immersing step to a first electrical conductivity characteristic of the liquid before the immersing step less a second ratio defined as a second surface tension characteristic different from the first surface tension characteristic of the liquid after the immersing step to a second electrical conductivity characteristic different from the first electrical conductivity characteristic of the liquid after the immersing step satisfies a relationship as follows:

$$350 \geqq \gamma r/\sigma r - \gamma s/\sigma s \geqq 0$$

wherein γr represents the surface tension characteristic of the liquid measured in units of mN/m before the immersing step; σr represents the electrical conductivity characteristic of the liquid measured in units of mS/m before the immersing step; γs represents the surface tension characteristic of the liquid measured in units of mN/m after the extracting step; and, σs represents the electrical conductivity characteristic of the liquid measured in units of mS/m after the extracting step.

9. The method according to claim 8, wherein the liquid is substantially pure water.

10. The method of claim 8 wherein the ink holding material is produced.

11. The method according to claim 8, wherein the ink absorbent material comprises nonwoven fabric.

12. The method according to claim 11, wherein the nonwoven fabric comprises chemical fiber as a main component.

* * * * *